US007066757B1

(12) United States Patent
Rengifo

(10) Patent No.: US 7,066,757 B1
(45) Date of Patent: Jun. 27, 2006

(54) ENVELOPING PIN ELECTRICAL CONTACT SYSTEM

(76) Inventor: Alex Rengifo, 16333 Deerpath La., La Puente, CA (US) 91744

( * ) Notice: Subject to any disclaimer, the term of this patent is extended or adjusted under 35 U.S.C. 154(b) by 0 days.

(21) Appl. No.: 10/944,951

(22) Filed: Sep. 20, 2004

(51) Int. Cl.
*H01R 13/625* (2006.01)
*H01R 4/50* (2006.01)

(52) U.S. Cl. ..... 439/332; 439/336

(58) Field of Classification Search ..... 439/332, 439/335, 333, 336–337, 118, 286, 311, 616, 439/644, 649, 671, 953
See application file for complete search history.

(56) References Cited

U.S. PATENT DOCUMENTS

| | | | | |
|---|---|---|---|---|
| 1,727,347 | A | 9/1929 | Knickerbocker | 200/50.28 |
| RE18,193 | E | 9/1931 | Kollath | 337/198 |
| 3,470,524 | A | 9/1969 | Culver | 439/317 |
| 4,003,622 | A | 1/1977 | Gartland, Jr. | 439/332 |
| 4,310,213 | A | 1/1982 | Fetterolf, Sr. et al. | 439/320 |
| 4,441,780 | A | 4/1984 | Walters | 439/609 |
| 4,442,327 | A | 4/1984 | West et al. | 200/51 R |
| H280 | H * | 6/1987 | Thigpen | 429/7 |
| 4,721,475 | A | 1/1988 | Burke, Jr. | 439/133 |
| 5,627,448 | A * | 5/1997 | Okada et al. | 439/133 |
| 5,932,841 | A | 8/1999 | Matsumoto et al. | 174/35 C |
| 6,814,625 | B1 * | 11/2004 | Richmond et al. | 439/681 |

FOREIGN PATENT DOCUMENTS

| | | |
|---|---|---|
| DE | 4210074 | 9/1993 |
| DE | 19943373 | 7/2001 |
| WO | WO03/034548 | 4/2003 |

* cited by examiner

*Primary Examiner*—Michael C. Zarroli
(74) *Attorney, Agent, or Firm*—Michael I Kroll

(57) ABSTRACT

An apparatus providing mating cylindrical contacts 12, 16 each having open ends and a central throughbore wherein the smaller reverse gender contact socket 12 is inserted into a larger enveloping pin contact 16 having interiorly projecting tines 18 that are outwardly displaced upon insertion of the contact socket. Flared ends 20, 22 are also disclosed on each contact 12, 16.

10 Claims, 8 Drawing Sheets

ENVELOPING PIN ELECTRICAL CONTACT SYSTEM

BACKGROUND OF THE INVENTION

1. Field of the Invention

The present invention relates generally to electrical contacts and, more specifically, to mating cylindrical contacts each having open ends and a central throughbore wherein the smaller reverse gender contact socket is inserted into a larger enveloping pin contact having interiorly projecting tines that are outwardly displaced upon insertion of the contact socket.

2. Description of the Prior Art

There are other electrical connection devices. Typical of these is U.S. Pat. No. 1,727,347 issued to E. Knickerbocker on Jul. 5, 1927.

Another patent was issued to F. C. Kollath on Sep. 15, 1931 as U.S. Pat. No. Re. 18,193. Yet another U.S. Pat. No. 3,470,524 was issued to P. C. Culver on Sep. 30, 1969 and still yet another was issued on Jan. 18, 1977 to A. J. Garland as U.S. Pat. No. 4,003,622.

Another patent was issued to J. R. Fetterolf Sr., et al. on Jan. 12 1982 as U.S. Pat. No. 4,310,213. Yet another U.S. Pat. No. 4,441,780 was issued to Gerald E. Walters on Apr. 10 1984. Another was issued to F. L. West, et al. on Apr. 10, 1984 as U.S. Pat. No. 4,442,327 and still yet another was issued on Jan. 26, 1988 to R. A. Burke, Jr. as U.S. Pat. No. 4,721,475.

Another patent was issued to M. Matsumoto et al. on Aug. 3, 1999 as U.S. Pat. No. 5,932,841, yet another International Patent No. DE4210074 was issued to Clemens Teichmann on Sep. 30, 1993. Another was issued to Ishizaki Kazuhisa et al. on Mar. 7, 2001 as International Patent No. DE19943373.

U.S. Pat. No. 1,727,347

Inventor: Earl Knickerbocker

Issued: Sept. 10, 1929

An electrical plug connection comprising a socket having a slot with an enlarged portion in its edge, a plug, cooperative contacts in the socket and in the plug to switch element carried by the plug having a head movable into the enlarged portion of the slot to latch the plug-to-the socket when the switch is closed and movable out of engagement with enlarged portion of the 1,5 slot when the switch is open U.S. Pat. No. Re. 18,193

Inventor: Francis C. Kollath

Issued: Sept. 15, 1931

An insulating base having electrical conductors therethrough, one end of said conductors terminating in electrical connectors, removable fuses in said base and forming a part of said conductors, a forwardly extending shield around said connectors and mounted on said. base, a flexible and resilient rubberlike caking around said base and extending over said shield, and means for removable securing said casing to said shield.

U.S. Pat. No. 3,470,524

Inventor: Perrin C. Culver

Issued: Sept. 30, 1969

A coupling arrangement having a rotatable ring received on one part to be connected and coaxial with a collar having a pin extending into a slot into the ring, which slot has a circumferential and an angular portion. The ring includes a second slot, also having circumferential and inclined portions adapted to receiving a pin projecting from the other part to be connected. The pins act as cams during the mating and unmating of the coupling, causing the ring to rotate to hold one of the pins behind an abutment when the coupling is connected.

U.S. Pat. No. 4,003,622

Inventor: Albert J. Gartland, Jr.

Issued: Jan. 18, 1977

An improved two-part electrical connector of the interlocking type. A generally cylindrical plug unit having a plurality of male electrical contacts extending from a front face thereof is provided. A generally cylindrical socket unit is adapted for mating with a plug unit. The socket unit has a front face with slots therein and a plurality of female electrical contacts beneath the slots to receive the male electrical contacts when the units are mated. The socket unit includes means for locking the plug and socket units against axial disengagement when the mated units are twisted with respect to one another. A generally cylindrical plug shroud element is mounted coaxially on the plug unit and a generally cylindrical socket shroud element is mounted coaxially on the socket unit and conforms circumferentially with the plug shroud element. Finally, manually actuable means are mounted in one of the shroud elements and movable to engage the other of the shroud elements to prevent relative rotation as between the plug and socket units on their common axis. In this manner, the plug and socket units are safely locked and cannot be accidentally disengaged. In the preferred embodiment of the invention the plug shroud element extends to at least the end of the male electrical contacts and serves to protect these contacts against damage. In this embodiment, the manually actuable means comprises a key mounted in a keyway in one of the shroud elements, and a keyway is also provided in the other of the shroud elements. The key is slidable to engage both keyways simultaneously to effect the desired locking.

U.S. Pat. No. 4,310,213

Inventor: James R. Fetterolf Sr., et al.

Issued: Jan. 12, 1982

A kit for an electrical connector is disclosed for use in connecting a first electrical device to a second electrical device; for example, connecting an audio microphone to a CB radio. The kit includes a cable guard member receiving therethrough a cable from the first device; first and second terminal members, with the first terminal members connected to conductors of the cable; and a connector housing having cavities extending therethrough to receive the second terminal members. The second terminal members are loaded into the cavities and the first terminal members subsequently inserted therein in mating engagement with the second terminal members. When the connector housing and cable guard member are connected together and the housing plugged into a socket mounted in the second electrical device, electrical connection is established between the first and second devices. The kit further includes cable strain relief means and coupling means to secure the connector to a mating connector.

U.S. Pat. No. 4,441,780

Inventor: Gerald E. Walters

Issued: Apr. 10, 1984

The plug of a plug and receptacle connector has a hollow cylindrical shell of such internal diameter as to permit its receipt onto and over a cylindrical receptacle shell during mating. A groove formed circumferentially about the inner wall of the plug includes a pair of intertwined continuous helically wound springs secured within the groove which wipes along the external wall of the receptacle as it is fitted within the plug. One of the wire springs has a cross-sectional dimension less than that of the other. At crossover points of the springs, they are bonded to one another. When received within the internal groove of the plug part, the large diameter helically wound part of the spring means is secured to the inner wall of the groove by use of a conductive material.

U.S. Pat. No. 4,442,327

Inventor: Frank L. West, et al.

Issued: Apr. 10, 1984

Electrically powered apparatus is provided with a remote primary control station from which energization of the apparatus is usually controlled, and a secondary control station, such as a jog control station, which is remote from the primary control station and close to the apparatus, from which energization of the apparatus may also be controlled. A single manual push button start control module may be mounted at either station, so that when the module is at the secondary station there is no start button at the primary station. A holding circuit provides for extended energization of the apparatus when the push button is momentarily depressed at the primary station, and there is a stop button at the primary station; while the secondary station has no holding circuit. The holding circuit is disabled when the module is mounted at the secondary station, so the apparatus cannot be energized by mounting a second identical start control module at the primary station.

U.S. Pat. No. 4,721,475

Inventor: Roland A. Burke

Issued: Jan. 26, 1988

A shrouded electrical connector assembly with a male plug and a female socket, the male plug being contained within an insulating cup-shaped shroud and the female socket being contained within another insulating cup-shaped shroud. The male plug cup-shaped shroud is telescopable into the female socket cup-shaped shroud and a bayonet-type contact is provided between the male plug shroud and the female socket shroud. The male plug shroud partially telescopes into the female socket shroud before the male plug engages the female socket, and the male plug shroud and the female socket shroud each have aligned and opposed apertures to permit the shank of a T-shaped locking bar to be inserted therethrough, physically preventing the male plug from being brought into contact with the female socket. The locking bar is secured to the shrouded electrical connector assembly by a flexible cable and its shank is provided with one or more apertures to permit a lock to be attached therethrough. The lock prevents the locking bar from being withdrawn from its locking position until the lock is removed.

U.S. Pat. No. 5,932,841

Inventor: M. Matsumoto

Issued: Aug. 3, 1999

A connecting structure of a metallic shielding member is provided with each of contacting elongations in the leading edge direction of male or female metallic shielding member in which a pair of engaging hook pieces to engage with the contacting elongation of one of the metallic shielding members are formed at the contacting elongation of the other metallic shielding member. The pair of engaging hook pieces are formed at both sides of the slit provided between the adjacent contacting elongations. The other connecting structure of a metallic shielding member in which each of the contacting elongations of both metallic shielding members equipped with male and female connectors is brought into contact with each other, a pressing spring is provided for energizing the contacting elongation of one of the metallic shielding members toward the contacting elongation of the other metallic shielding member at least in the connector housing on one side. Furthermore, there are provided a contacting projection for both contacting elongations and an enlarged diameter portion for the contacting projection.

International Publication Number DE4210074

Inventor: Clemens Teichmann

Issued: Sept. 30, 1993

The battery lamp has a tubular housing receiving cylindrical batteries with a mechanical and electrical connection to a second tubular housing this contains extra batteries. The lamp bulb is held within an electrical reflector unit at the top end of the first tube and the switch is at the inclined top end face of the second tube.

International Publication Number DE19943373

Inventor: Kazuhisa Ishizaki

Issued: Jul. 3, 2001

A female type terminal for a large current, an assembling method of the female type terminal includes: a male type terminal being in a rod-like shape; a female type terminal having a cylindrical terminal body in which the male type terminal is inserted, the terminal body having a large diameter portion at the end thereof.

While these electrical contacts may be suitable for the purposes for which they were designed, they would not be as suitable for the purposes of the present invention, as hereinafter described.

SUMMARY OF THE PRESENT INVENTION

The present invention discloses mating cylindrical contacts each having open ends and a central throughbore wherein the smaller reverse gender contact socket is inserted into a larger enveloping pin contact having interiorly projecting tines that are outwardly displaced upon insertion of the contact socket. Flared ends are also disclosed on each contact.

A primary object of the present invention is to provide a pair of cylindrical mating electrical contacts that are concentrically displaced.

Another object of the present invention is to provide electrical contacts that include an enveloping pin having a central throughbore extending longitudinally therethrough and inwardly projecting tines cut from the body thereof.

Yet another object of the present invention is to provide electrical contacts that include a reverse gender contact socket having a central throughbore extending longitudinally therethrough.

Still yet another object of the present invention is to provide electrical contacts wherein the reverse gender contact socket is inserted into the enveloping pin and the inwardly projecting tines thereof are spread outwardly surrounding the reverse gender contact socket.

Another object of the present invention is to provide electrical contacts that are simple, easy to use and repairable.

Yet another object of the present invention is to provide electrical contacts that are inexpensive to manufacture and operate.

Still another object of the present invention is to provide intermatability with the standard mil-spec interface as detailed in M83513.

Additional objects of the present invention will appear as the description proceeds.

The present invention overcomes the shortcomings of the prior art by providing electrical contacts that may be fabricated by deep draw tooling rather than progressive die or twist pin tooling which are cost-prohibitive.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
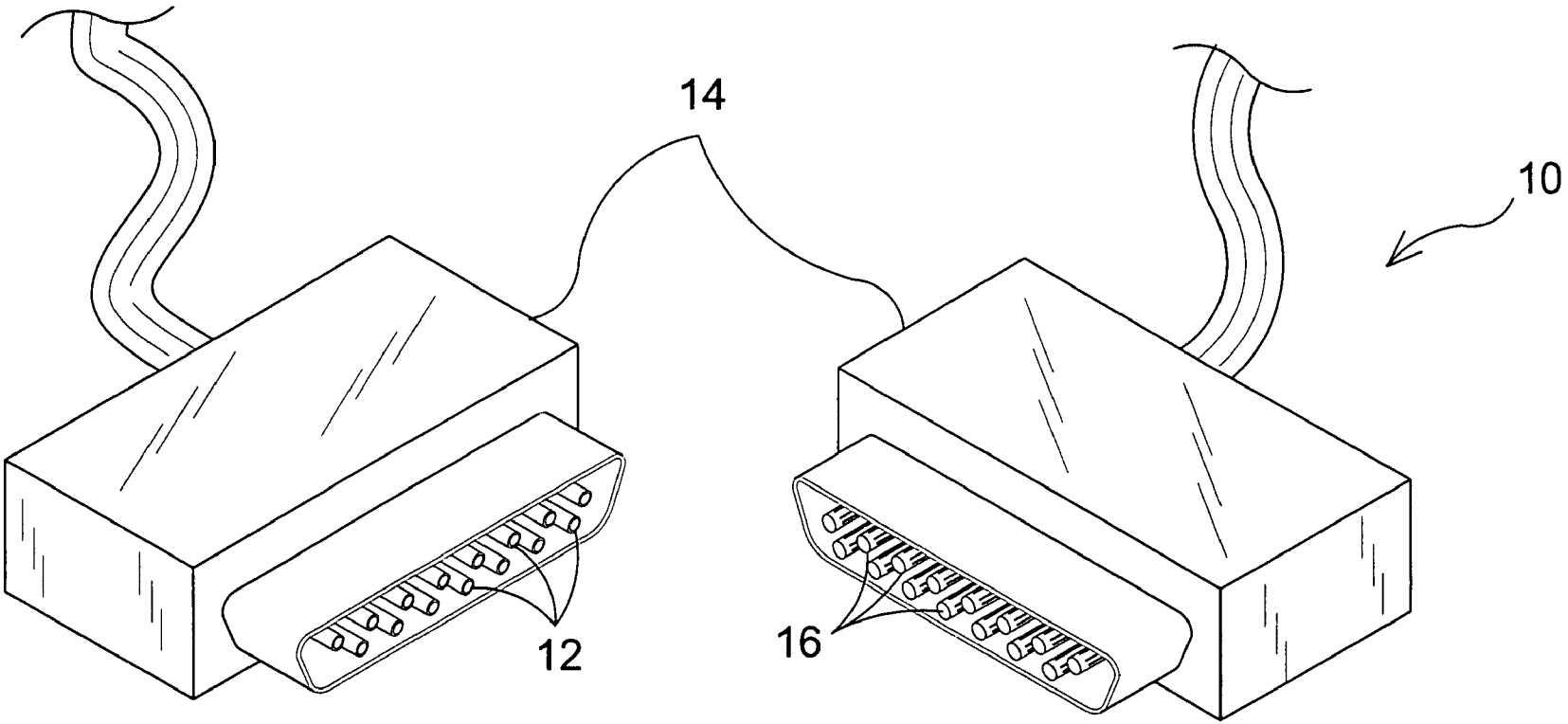
FIG. 1 is a perspective view of the present invention.

With regard to reference numerals used, the following numbering is used throughout the drawings.

10 present invention
12 standard socket
14 reverse gender configuration
16 enveloping pin
18 tines
20 flared end of enveloping pin
22 flared end of contact
24 plug housing
26 receptacle housing
28 tangential forces
30 plug contact retainer
32 receptacle contact retainer
34 plug assembly
36 receptacle assembly

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is a perspective view of the present invention 10. The present invention 10 is an electrical contact system featuring a standard socket 12 in reverse gender configuration 14 and a larger socket 16 hereinafter referred to as the enveloping pin 16 that slides over the standard socket in an enveloping fashion. The electrical contact system of the present invention 10 may be adapted for use with any number of reverse gender electrical connectors 14.

Figure 2:
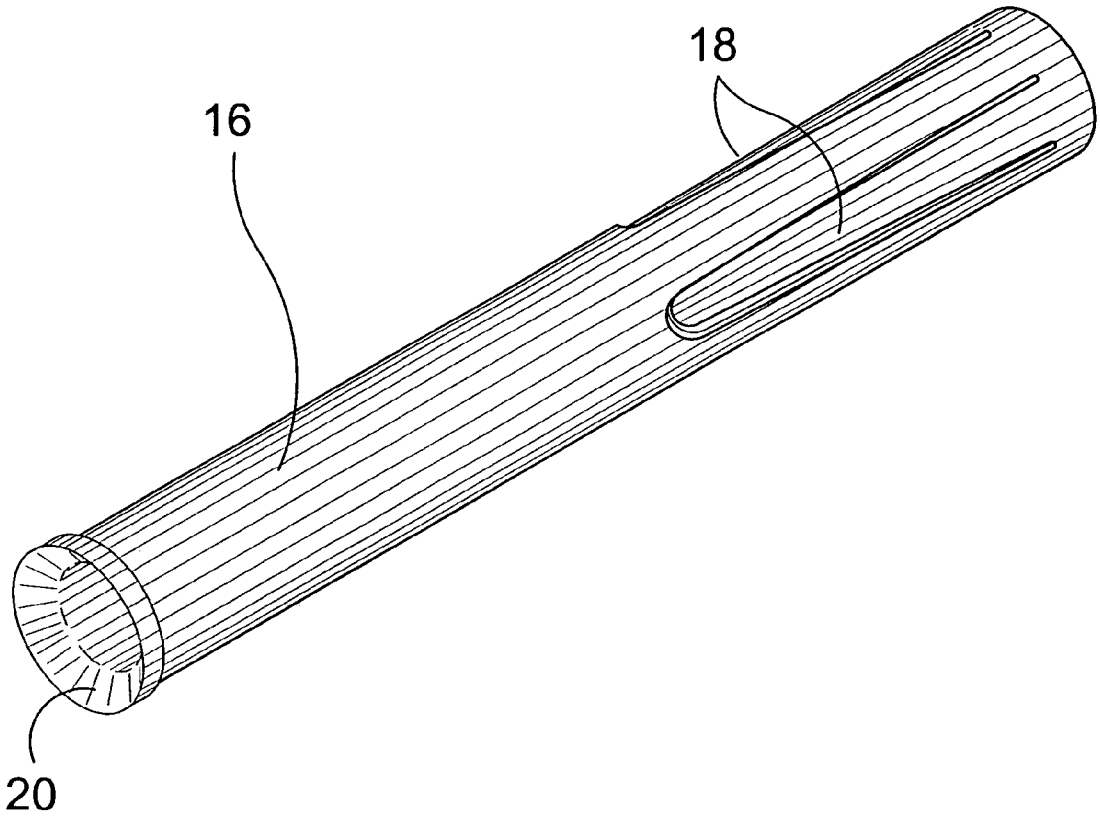
FIG. 2 is a perspective view of the enveloping pin of the present invention.

Turning to FIG. 2, shown therein is a perspective view of the enveloping pin 16 of the present invention. Shown is the enveloping pin 16 of the present invention having a plurality of interiorly projecting tines 18. The enveloping pin 16 design includes an open flared end 20 feature at the base of the contact and a throughbore, which is used as part of a contact retention mechanism. This mechanism will be epoxy free and will allow the end user to build and repeatedly repair this connector. End user repairability is not possible with the mil-spec design (M83513) and is not practical with other commercial grade designs due to retention mechanisms that are limited to one-time use.

Figure 3:
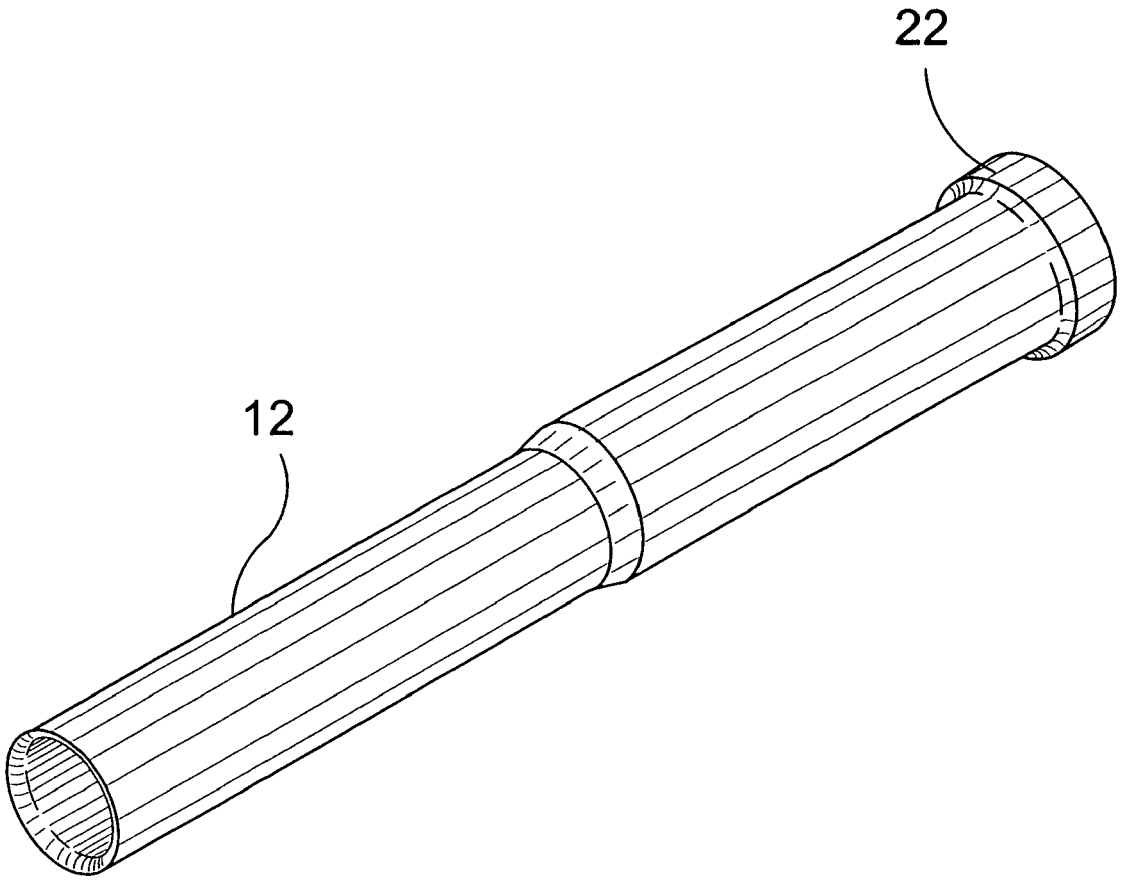
FIG. 3 is a perspective view of the reverse gender contact socket of the present invention.

Turning to FIG. 3, shown therein is a perspective view of the reverse gender contact socket 12 of the present invention. The reverse gender contact socket 12 being open on its end and having a throughbore is inserted into the respective enveloping pin and expands the tines of the enveloping pin. Flared end 22 is also shown.

Figure 4:
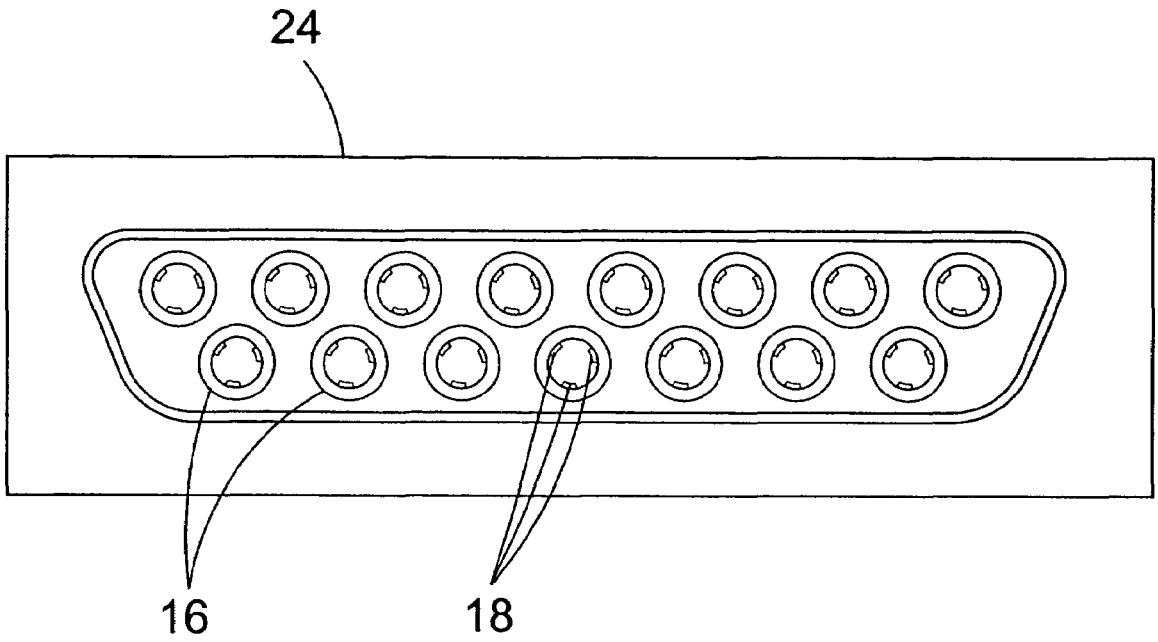
FIG. 4 is a perspective view of a plug connector assembly with a plurality of enveloping pins associated therewith.

Turning to FIG. 4, shown therein is a perspective view of a plug connector assembly 24 with a plurality of enveloping pins 16 associated therewith. Shown is a plug connector assembly 24 with enveloping pins 16 with interiorly projecting tines 18 wherein a mating connector with corresponding reverse gender socket contacts is to be attached thereto to form an appropriate electrical connection. Conventional reverse gender receptacle connectors are also intermatable with the plug connector 24 herein.

Figure 5:
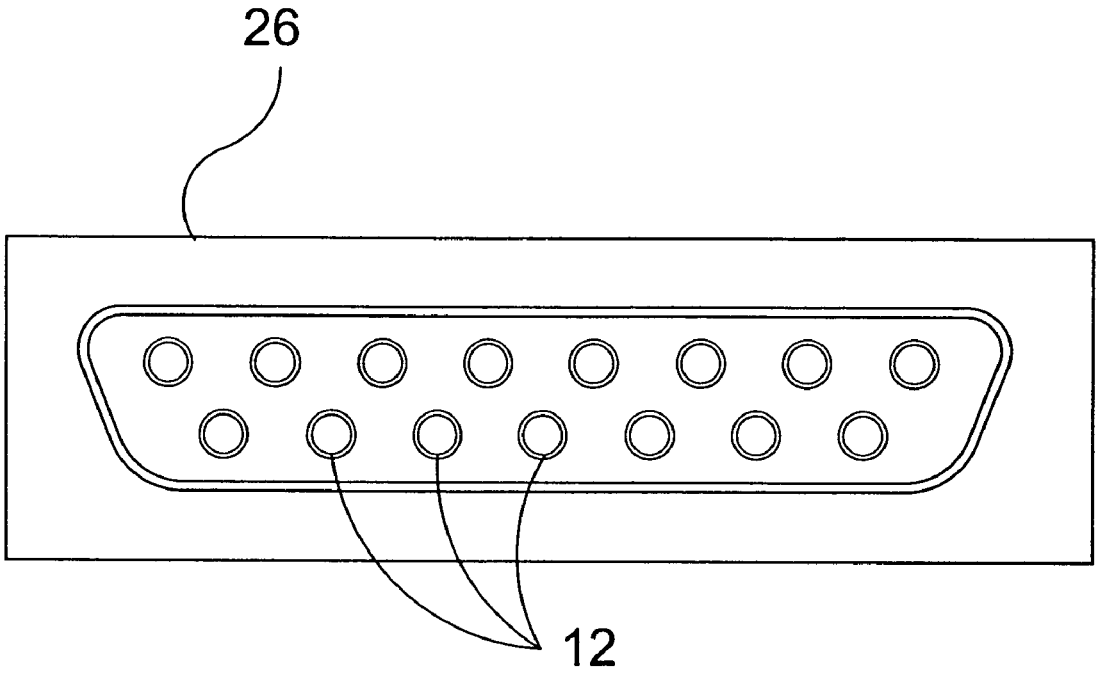
FIG. 5 is a perspective view of a receptacle connector assembly with a plurality of reverse gender socket contacts associated therewith.

Turning to FIG. 5, shown therein is a perspective view of a receptacle connector assembly 26 with a plurality of reverse gender socket contacts 12 associated therewith. Shown is a receptacle connector assembly 26 with reverse gender socket contacts 12 wherein a mating connector with corresponding enveloping pins with interiorly projecting tines is to be attached thereto to form an appropriate electrical connection. Conventional reverse gender plug connectors are also intermatable with the receptacle connector 26 herein.

Figure 6:
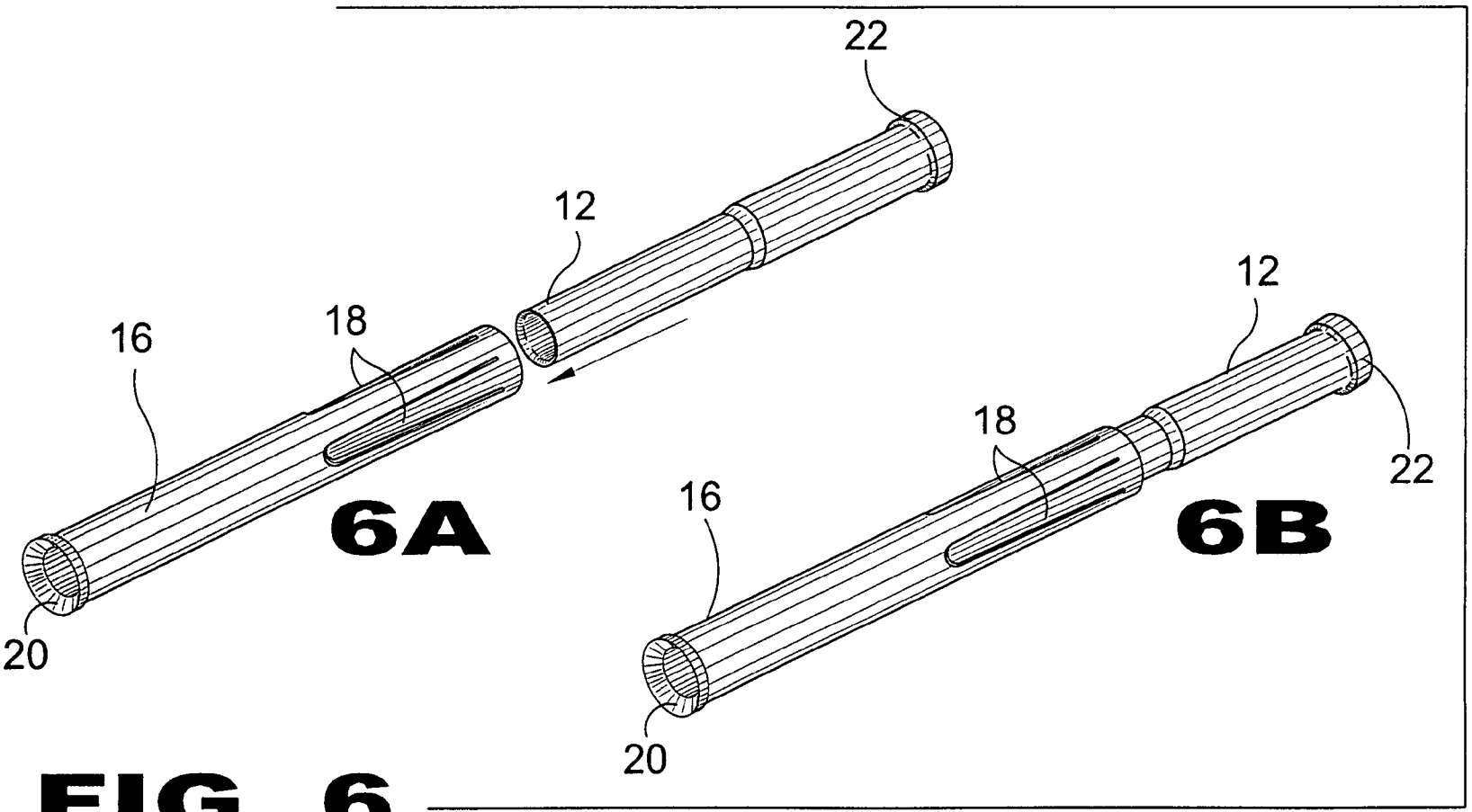
FIG. 6 is a sectional side view of a reverse gender socket contact inserted into an enveloping pin.

Turning to FIG. 6, shown therein is an elevational perspective view of a reverse gender socket contact 12 inserted into an enveloping pin 16. Shown is the reverse gender socket contact 12 inserted into an enveloping pin 16. The reverse gender socket 12 functions as the male part while the enveloping pin 16 functions as the female part. The tines 18 of the enveloping pin 16 will flex outwardly due to the tangential forces created by inserting the reverse gender socket therein. Flared ends 20, 22 are also shown.

Figure 7:
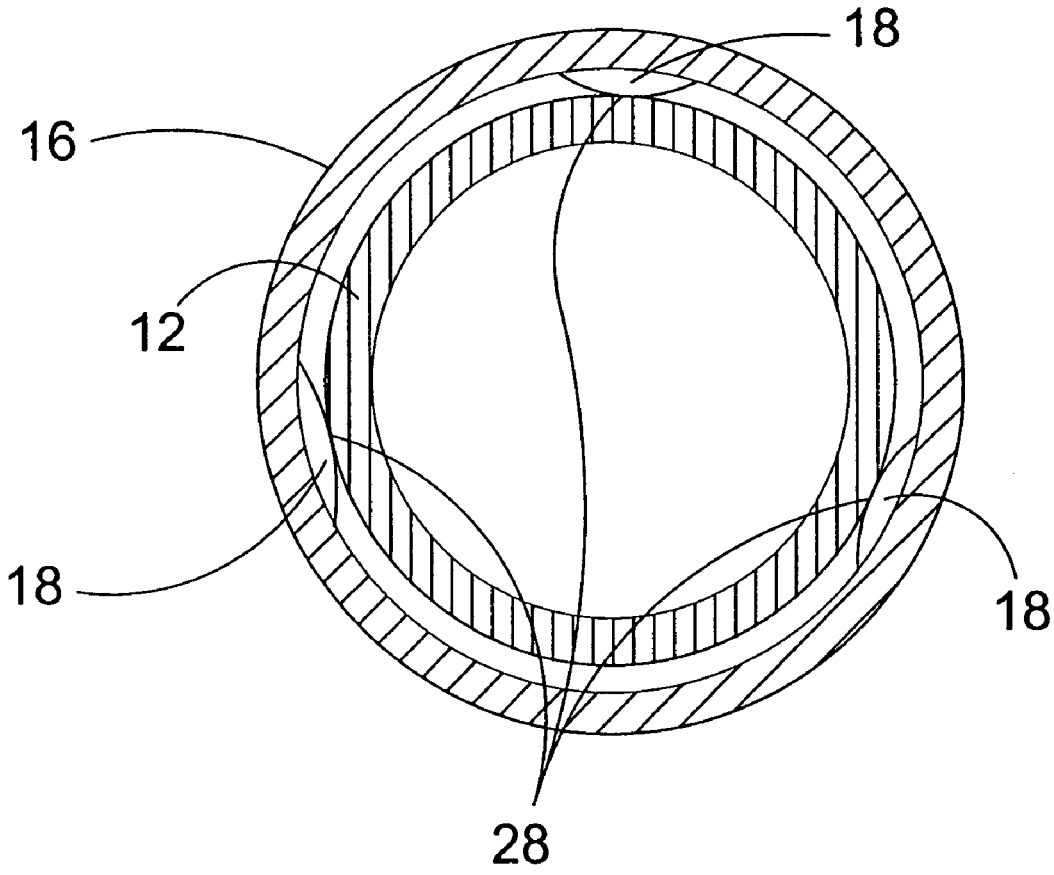
FIG. 7 is a sectional view of a mated pair of contacts.

Turning to FIG. 7, shown therein is a sectional view of the mated pair of contacts 12, 16. Shown is the reverse gender socket 12 contact inserted into an enveloping pin 16 causing the inwardly projecting tines 18 of the enveloping pin to engage the reverse gender socket to generate tangential forces at the point of contact 28.

Figure 8:
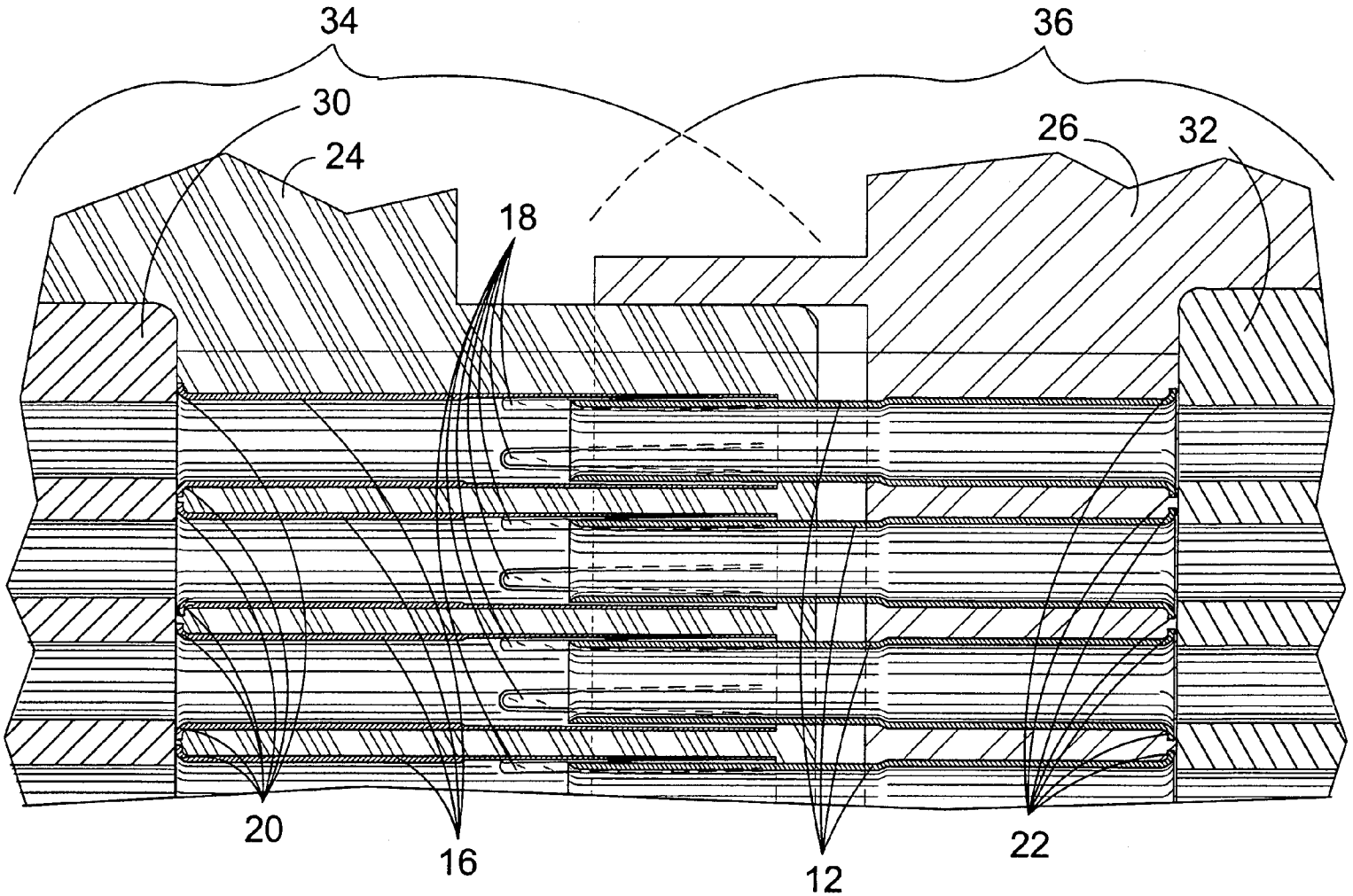
FIG. 8 is a sectional view of a mated pair of connector assemblies.

Turning to FIG. 8, shown therein is a sectional view of a mated pair of connector assemblies 34, 36. Shown is a plurality of mated contacts positioned within their respective connector housings 24, 26. The mating members are comprised of tubular housings having flared bases 20, 22 used to provide repairability of the respective connectors. One of the mating members 16 has a plurality of inwardly projecting tines 18 of such a thickness as to be resilient and memory retentive as to form. The other tubular contact 12 will reside within its opposing enveloping pin 16 and in engagement with the tines 18 thereby providing an electrical connection therewith. Flared ends 20, 22 are also shown along with the plug contact retainer 30 and receptacle contact retainer 32.

I claim:

1. An apparatus for forming an electrically conductive path, comprising:

a) a reverse gender contact socket comprising an electrically conductive tubular member having a throughbore;

b) an enveloping pin comprising an electrically conductive tubular member having a throughbore; and c) said tubular member of said reverse gender contact socket being circumferentially smaller than said tubular member of the enveloping pin whereby said reverse gender contact socket can be inserted into the throughbore of the enveloping pin, wherein a plurality of reverse gender contact sockets can be used in conjunction with a receptacle housing to form a receptacle assembly and said reverse gender contact socket has a flange forming a base at one distal end providing means for retaining said contact socket within receptacle assembly.

2. The apparatus of claim 1, wherein said enveloping pin has a plurality of interiorly projecting tines being disposed in the wall so as to contact said reverse gender contact socket when inserted therein.

3. The apparatus of claim 2, wherein said tines are flexible.

4. The apparatus of claim 3, wherein said tines are memory retentive.

5. The apparatus of claim 4, wherein said tines retain said reverse gender contact socket within said enveloping pin by frictionally engaging said reverse gender contact socket.

6. The apparatus of claim 1, wherein said reverse gender contact socket is removable from said receptacle assembly.

7. The apparatus of claim 1, wherein a plurality of enveloping pins can be used in conjunction with a plug housing to form a plug assembly.

8. The apparatus of claim 7, wherein said enveloping pin has a flange forming a base at one distal end providing means for retaining said enveloping pin within plug assembly.

9. The apparatus of claim 8, wherein said enveloping pin is removable from said plug assembly.

10. The apparatus of claim 9, wherein mating receptacle assembly and plug assembly form a repairable electrically conductive assembly.

* * * * *